US006448897B1

(12) United States Patent
Ku

(10) Patent No.: US 6,448,897 B1
(45) Date of Patent: Sep. 10, 2002

(54) FUSE ASSEMBLY HAVING A WARNING OR INDICATING DEVICE

(75) Inventor: Jung Sheng Ku, Chong Ho (TW)

(73) Assignee: Glorytech Technology Co., LTD, Taipei Hsien (TW)

( * ) Notice: Subject to any disclaimer, the term of this patent is extended or adjusted under 35 U.S.C. 154(b) by 0 days.

(21) Appl. No.: 09/865,567

(22) Filed: May 25, 2001

(51) Int. Cl.[7] ..... G08B 21/00

(52) U.S. Cl. ..... 340/638; 340/691.1; 340/693.5; 324/507; 324/550; 337/241; 337/266; 361/104

(58) Field of Search ..... 340/638, 639, 340/691.1, 693.5; 337/241, 242, 245, 266; 335/17; 361/104; 324/133, 507, 550

(56) References Cited

U.S. PATENT DOCUMENTS 4,499,447 A * 2/1985 Greenberg ..... 337/266
4,661,807 A * 4/1987 Panaro ..... 340/638
5,701,118 A * 12/1997 Hull et al. ..... 340/638
5,739,737 A * 4/1998 Hatton ..... 337/206
5,874,884 A * 2/1999 Hull et al. ..... 337/241
5,986,558 A * 11/1999 Crawford et al. ..... 340/638

* cited by examiner

*Primary Examiner*—Daniel J. Wu

(57) ABSTRACT

A fuse device includes two prongs secured in a casing, and a fuse member secured between the prongs. An indicating device is electrically coupled to the prongs or to the fuse member for generating a warning or an indicating signal when the fuse member is broken. The indicating device includes a pair of conductor blades electrically coupled to the prongs, and an indicating member, such as a light device or a buzzer, secured between the conductor blades for generating an indicating light or a warning sound when the fuse member is broken.

3 Claims, 7 Drawing Sheets

FUSE ASSEMBLY HAVING A WARNING OR INDICATING DEVICE

BACKGROUND OF THE INVENTION

1. Field of the Invention

The present invention relates to a fuse, and more particularly to a fuse assembly having a warning or indicating device.

2. Description of the Prior Art

Typical fuses includes a pair of conductor blades or prongs secured in a transparent casing, and a fuse member secured between the conductor blades. No warning or indicating devices may be used for warning the users that the fuse member has been burned out or has been broken.

The present invention has arisen to mitigate and/or obviate the afore-described disadvantages of the conventional fuses.

SUMMARY OF THE INVENTION

The primary objective of the present invention is to provide a fuse assembly having a warning or indicating device for indicating that the fuse member has been burned out or has been broken, and for allowing the user to change the fuse member right away.

In accordance with one aspect of the invention, there is provided a fuse assembly comprising a casing, two prongs secured in the casing, a fuse member received in the casing and secured between the prongs, and means for generating an indicating signal when the fuse member is broken.

The indicating signal generating means includes a pair of conductor blades electrically coupled to the prongs respectively, and an indicating member secured between the conductor blades. The indicating member may be a light device, or a buzzer, or the like, for generating an indicating light or a warning sound when the fuse member is broken, such that the users may know that the fuse member has been broken and may change the fuse member right away.

The conductor blades each includes a first end having a slot formed therein for receiving the prongs and for electrically coupled to the prongs respectively.

The indicating member includes two legs secured to the conductor blades respectively for electrically coupled to the conductor blades.

The indicating signal generating means further includes a cap attached to the ends of the conductor blades. The cap may be secured to the casing, or may include a latch or a catch or the like for engaging with the casing and for securing the casing and thus the conductor blades to the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
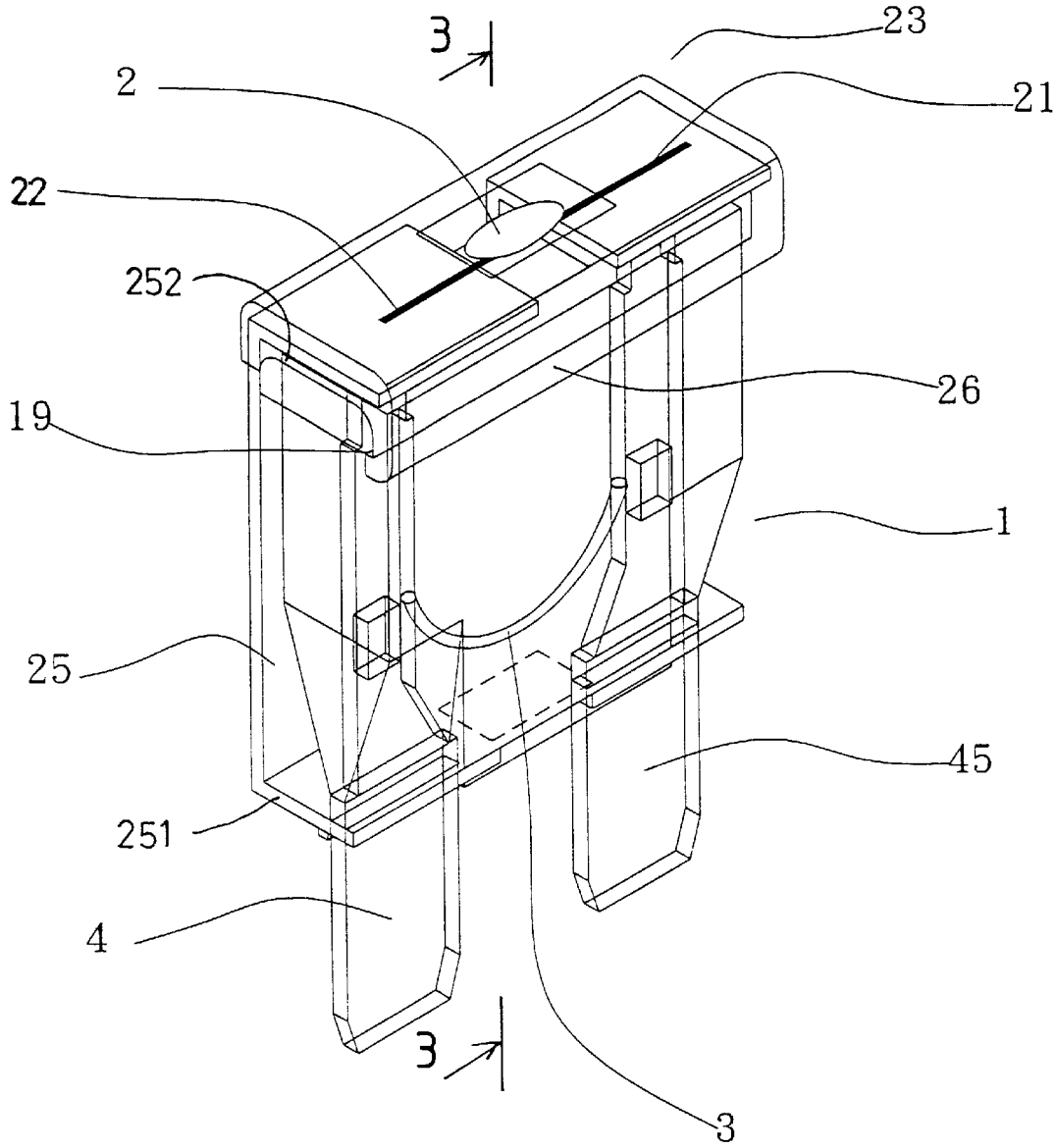
FIG. 1 is a perspective view of a fuse assembly in accordance with the present invention.
Figure 2:
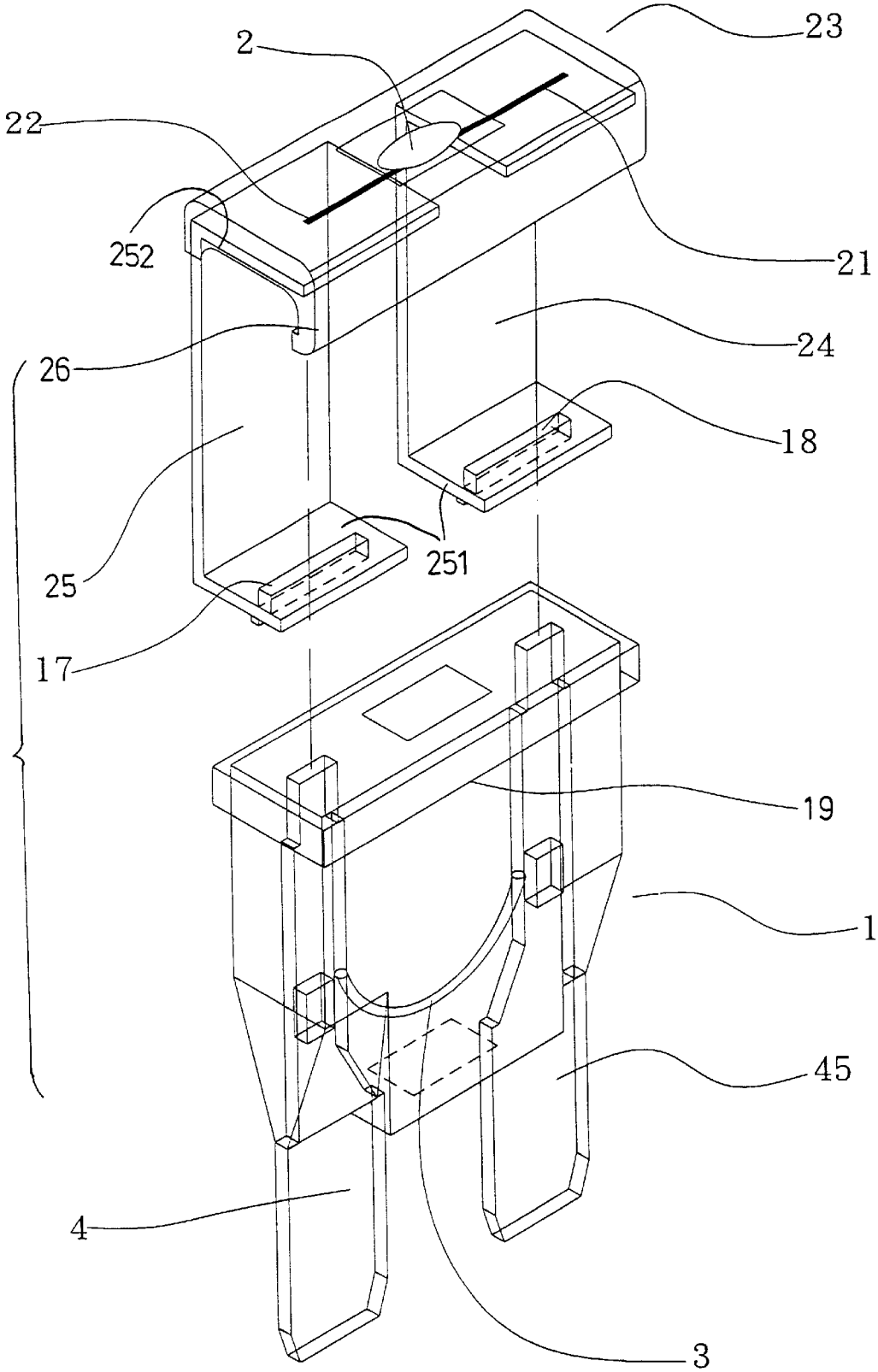
FIG. 2 is a partial exploded view of the fuse assembly.
Figure 3:
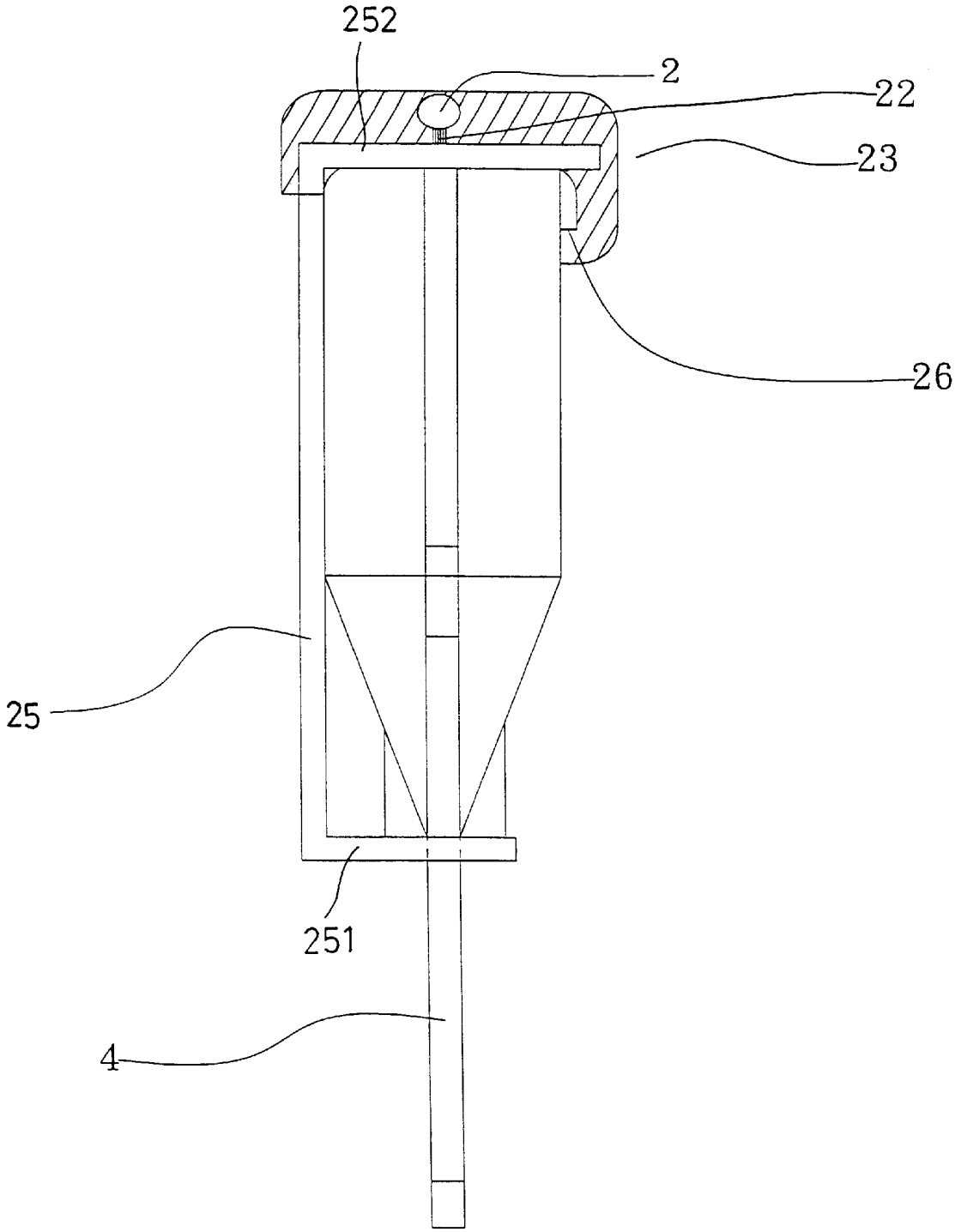
FIG. 3 is a cross sectional view taken along lines 3—3 of FIG. 1.

Referring to the drawings, and initially to FIGS. 1–3, a fuse assembly in accordance with the present invention comprises a typical casing 1 which is normally transparent, two conductor blades or prongs 4, 45 secured in the transparent casing 1, and a fuse member 3 secured between the prongs 4, 45. The fuse 3 may be seen through the transparent casing 1 such that the fuse 3 may be seen or checked whether it has been burned out or broken or not. The casing 1 includes a lock shoulder or a lock flange 19 provided in the front and upper portion thereof.

Figure 4:
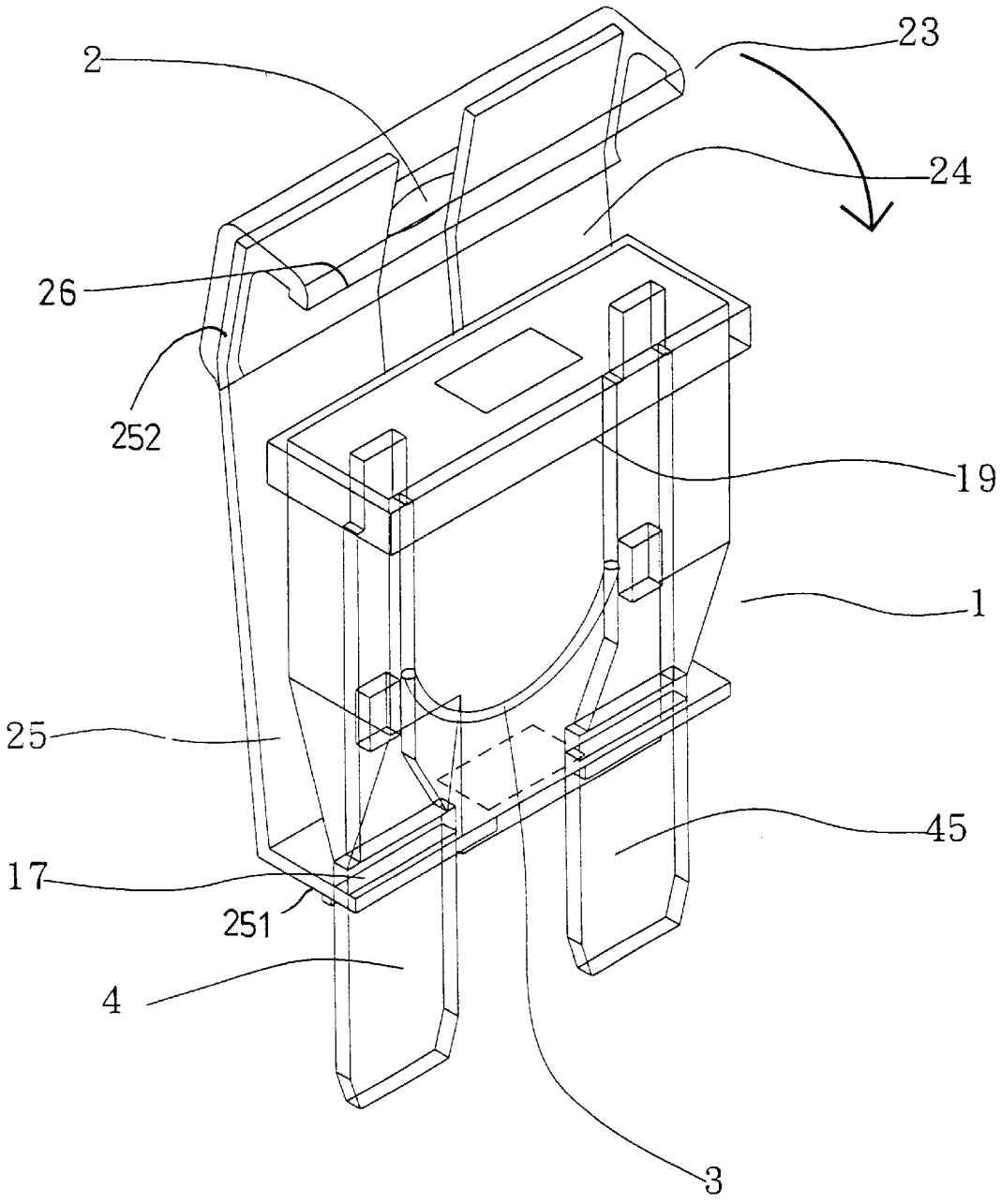
FIGS. 4 and 5 are perspective views illustrating the operation of the fuse assembly.

The fuse assembly in accordance with the present invention further comprises an indicating or a warning device, such as a light device 2, and such as a light emitting diode or a liquid crystal displayer, including two legs 21, 22 extended therefrom, and secured in a cap 23 or the like. Two conductor blades 24, 25 each includes a lower end 251 bent forward from the bottom portion thereof and having a slot 18, 17 formed therein for receiving the prongs 4, 45 and for electrically coupling to the prongs 4, 45 respectively. The conductor blades 24, 25 each includes an upper end 252 bent forward from the upper portion thereof and engaged with the legs 21, 22 of the light device 2 respectively, such that the legs 21, 22 of the light device 2 may be electrically coupled to the prongs 4, 45 respectively. The cap 23 includes a lock ear 26 provided in the front portion thereof for engaging with the lock flange 19 of the casing 1, and for securing the conductor blades 24, 25 to the casing 1, best shown in FIGS. 1 and 4.

The legs 21, 22 of the light device 2 may be electrically coupled to or secured to the upper ends 252 of the conductor blades 24, 25 by molding the light device 2 and the upper ends 252 of the conductor blades 24, 25 in the casing 1. Or, the legs 21, 22 of the light device 2 may be electrically secured to the upper ends 252 of the conductor blades 24, 25 by welding processes before being molded into the casing 1.

Figure 5:
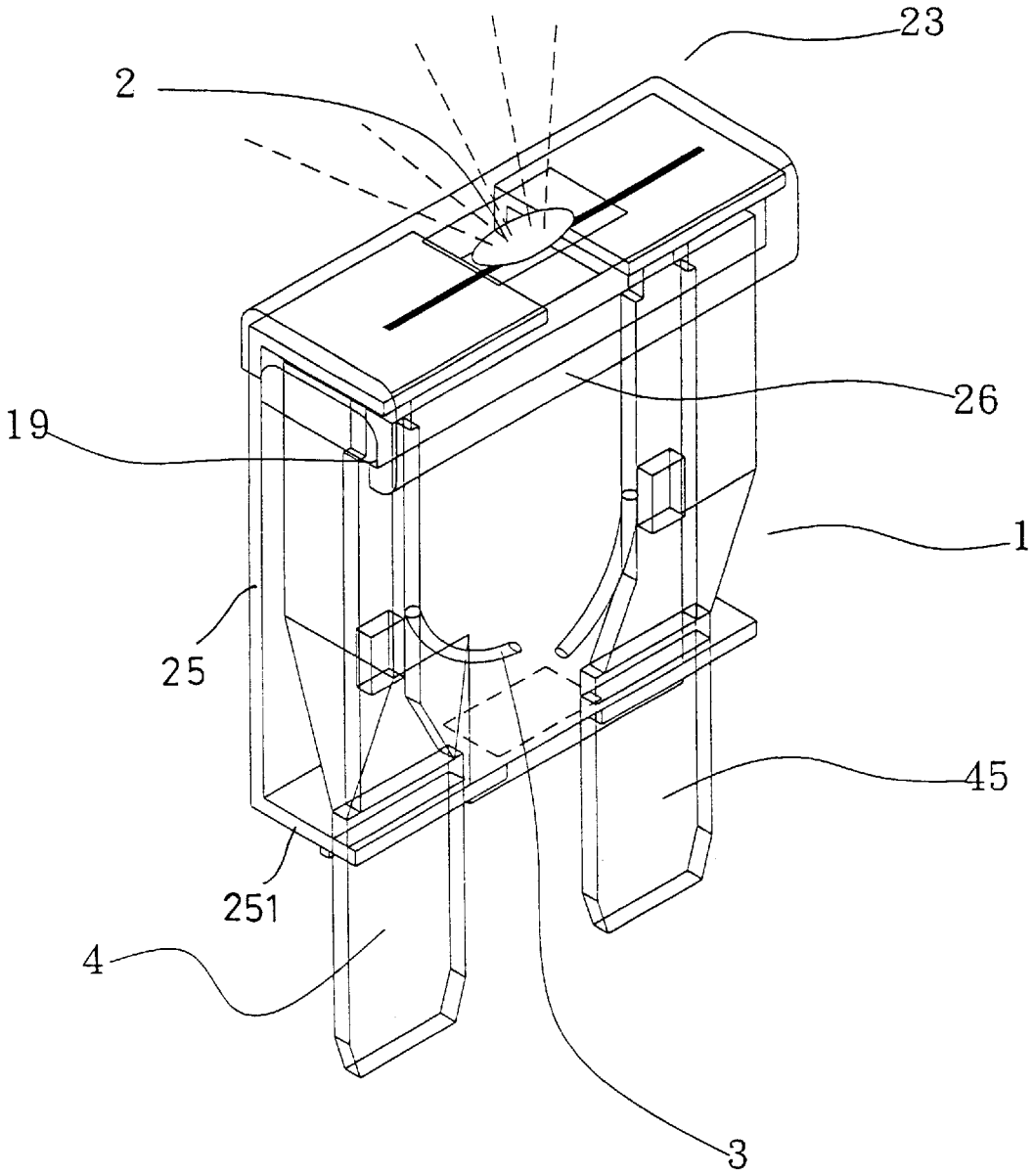

The light device 2 includes a resistance greater than that of the fuse member 3, such that the light device 2 will not be energized when the fuse member 3 has not been broken. In operation, as shown in FIG. 5, the light device 2 may be energized when or only when the fuse member 3 has been burned out or has been broken. The light device 2 may thus generate a light to warning the users that the fuse member 3 has been broken.

Alternatively, the warning or indicating device 2 may also be a buzzer or the like, for generating a warning sound when the fuse member 3 is broken.

It is to be noted that the conductor blades 24, 25 and the cap 23 may be attached onto the typical fuse casing 1 with the other securing or attaching mechanism, for allowing the conductor blades 24, 25 and the cap 23 to be attached onto various kinds of typical fuse members. The conductor blades 24, 25 may also be directly and electrically coupled to the fuse member 3 instead of being coupled to the prongs 4, 45.

Figure 6:
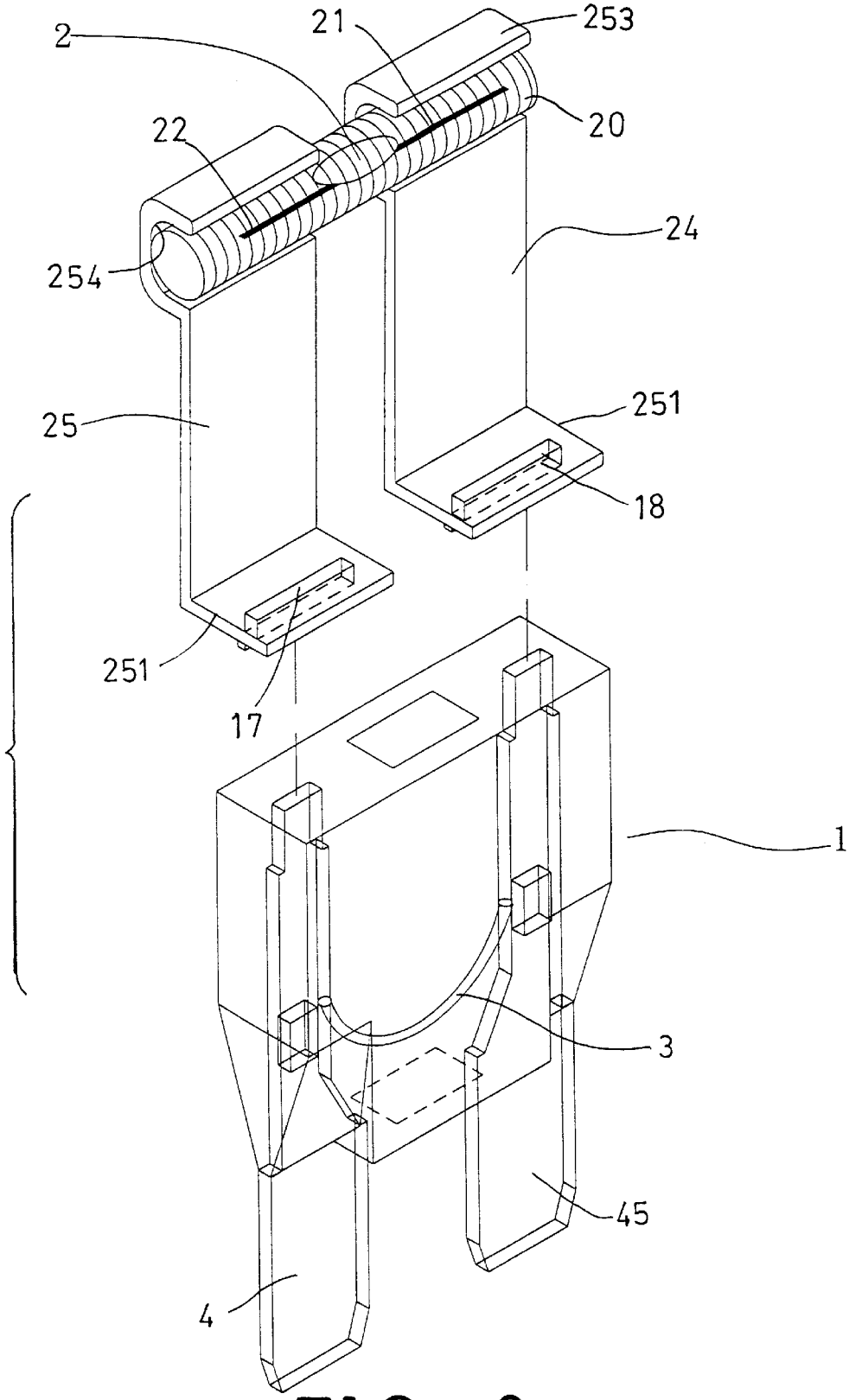
FIGS. 6 and 7 are partial exploded views illustrating the other embodiments of the fuse assembly.
Figure 7:
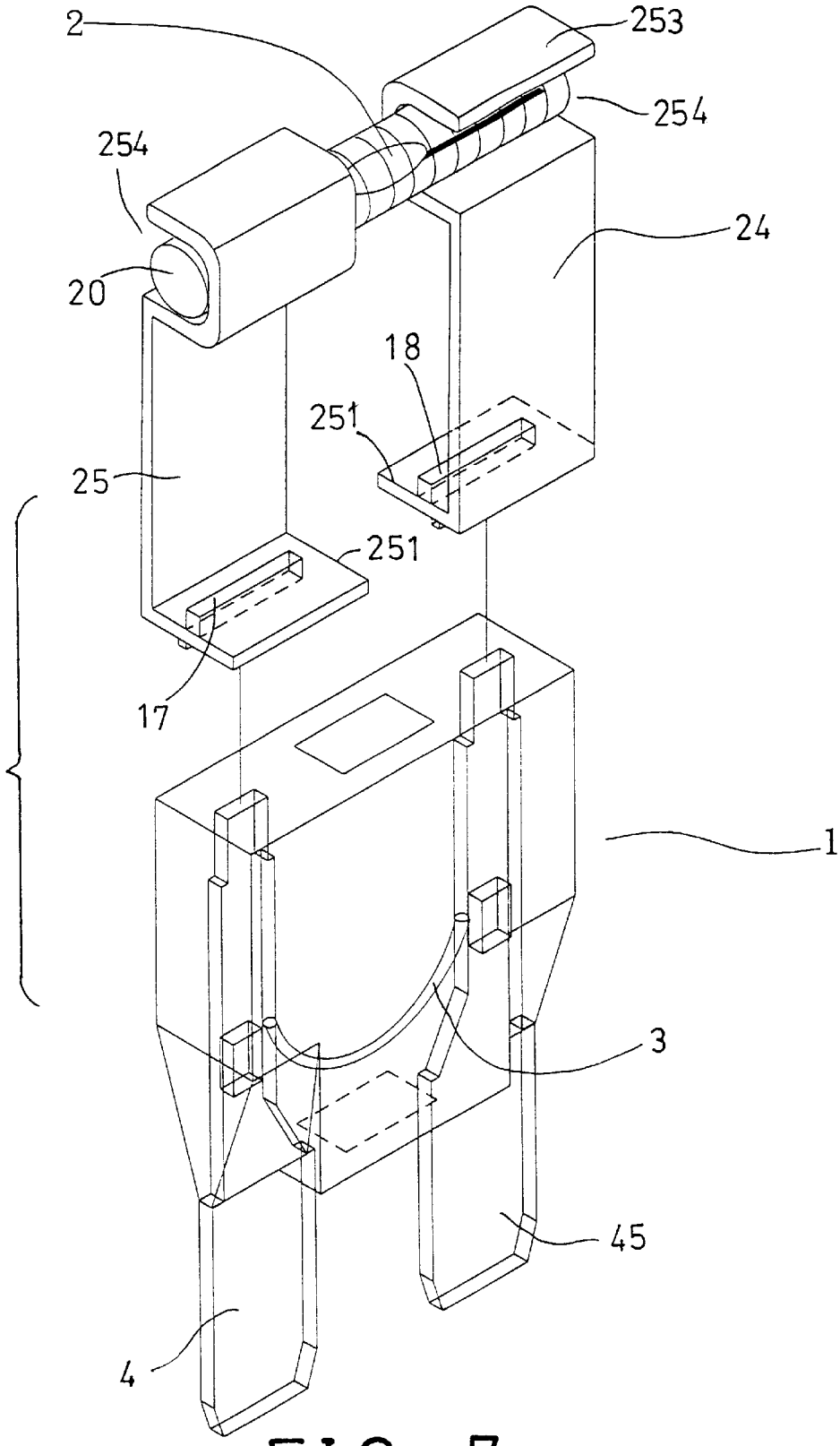

Referring next to FIGS. 6 and 7, the conductor blades 24, 25 may each include a frame 253 formed or provided on top thereof and having a chamber 254 formed therein for receiving the ends 20 of a cartridge fuse device 2. The conductor blades 24, 25 may be secured onto the casing 1 by the conductor blades 24, 25 themselves when the conductor blades 24, 25 are disposed in opposite directions (FIG. 7), or may be attached to the casing 1 with a hook and loop device or the like.

Accordingly, the fuse assembly in accordance with the present invention includes a warning or indicating device for indicating that the fuse member has been burned out or has been broken, and for allowing the user to change the fuse member right away.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fuse assembly comprising:

a casing, two prongs secured in said casing, a fuse member received in said casing and secured between said prongs, a pair of conductor blades electrically coupled to said prongs respectively, said conductor blades each including a first end having a slot formed therein for receiving said prongs respectively, and each including a second end for detachably engaging onto said casing, and an indicating member secured between said second ends of said conductor blades.

2. The fuse assembly according to claim 1 further comprising a cap attached to said first ends of said conductor blades.

3. The fuse assembly according to claim 2, wherein said cap includes a lock ear provided thereon for engaging onto said casing and for securing said cap and said conductor blades to said casing.

* * * * *